United States Patent [19]

Ariyama

[11] Patent Number: 5,063,415

[45] Date of Patent: Nov. 5, 1991

[54] IMAGE FORMING APPARATUS

[75] Inventor: Takayuki Ariyama, Toyokawa, Japan

[73] Assignee: Minolta Camera Kabushiki Kaisha, Osaka, Japan

[21] Appl. No.: 595,248

[22] Filed: Oct. 10, 1990

[30] Foreign Application Priority Data

Oct. 13, 1989 [JP] Japan ..... 1-266660
Aug. 10, 1990 [JP] Japan ..... 2-212188

[51] Int. Cl.[5] ..... G03G 15/00

[52] U.S. Cl. ..... 355/312; 355/309; 355/321; 271/194; 271/283

[58] Field of Search ..... 355/312, 308, 309, 73, 355/321; 271/3.1, 184, 194, 195, 283

[56] References Cited

U.S. PATENT DOCUMENTS

| | | | |
|---|---|---|---|
| 3,794,417 | 2/1974 | Machmer | 355/290 |
| 3,873,196 | 3/1975 | Ogawa | 355/312 |
| 3,989,368 | 11/1976 | Sohm | 355/309 |
| 4,234,305 | 11/1980 | Miyake et al. | 219/216 X |
| 4,286,863 | 9/1981 | Cornwall | 355/312 X |
| 4,417,800 | 11/1983 | Hirose et al. | 355/315 |
| 4,493,548 | 1/1985 | Ateya | 271/195 X |
| 4,525,057 | 6/1985 | Kaufmann | 355/295 |
| 4,839,697 | 6/1989 | Kamitamari et al. | 355/309 |
| 4,843,214 | 6/1989 | Higashi | 355/309 X |
| 4,862,215 | 8/1989 | Noniura | 355/309 |
| 4,903,047 | 2/1990 | Hatanaka | 355/312 |
| 4,924,266 | 5/1990 | Negoro et al. | 355/308 X |
| 4,952,982 | 8/1990 | Tabuchi | 355/312 X |

FOREIGN PATENT DOCUMENTS

| | | |
|---|---|---|
| 63-138554 | 9/1988 | Japan . |
| 64-44475 | 2/1989 | Japan . |

*Primary Examiner*—R. L. Moses

*Attorney, Agent, or Firm*—Willian, Brinks, Olds, Hofer, Gilson & Lione

[57] ABSTRACT

An image forming apparatus comprising: an image forming device for forming a toner image on a photosensitive member; a transfer device for transferring the toner image to a recording paper sheet; a fixing device for fixing the toner image onto the recording paper sheet, which is so provided as to be spaced a predetermined distance from the transfer device; a guide member which has first and second inclined faces for guiding the recording paper sheet obliquely upwardly and downwardly to the fixing device, respectively; the first and second inclined faces being, respectively, formed with first and second suction openings; a transport belt device for transporting the recording paper sheet to the fixing device along the first and second inclined faces, which is wound along the first and second inclined faces and is formed with a plurality of holes; and a suction device which sucks air above the first inclined face through the holes of the transport belt device and the first suction opening and sucks air above the second inclined face through the holes of the transport belt device and the second suction opening so as to bring the recording paper sheet into close contact with the first and second inclined faces, respectively.

12 Claims, 4 Drawing Sheets

IMAGE FORMING APPARATUS

BACKGROUND OF THE INVENTION

The present invention relates to an image forming apparatus such as a copying apparatus, a printer, a facsimile machine, etc.

In known image forming apparatuses employing powdery toner, toner transferred to a transfer medium at a transfer section is fixed, through heating, onto the transfer medium at a fixing section. However, in a compact image forming apparatus, since a distance from the transfer section to the fixing section is short, a leading edge of the transfer medium proceeds into the fixing portion while toner is being transferred to the transfer medium, so that an impact force caused by feeding of the transfer medium into the fixing section is transmitted to the transfer medium disposed at the transfer section and thus, the transferred toner image is disordered, thereby resulting in aggravation of image quality.

Therefore, in order to eliminate the above described inconvenience, Japanese Utility Model Laid-Open Publication No. 63-138554 proposed an image forming apparatus in which two air suction type conveyor devices are provided between the transfer section and the fixing section and transport speed of one of the conveyor devices is made different from that of the other of the conveyer devices so as to form a slack of the transfer medium between the conveyor devices such that the impact force caused by delivery of the transfer medium into the fixing section is absorbed by the slack of the transfer medium.

However, this prior art image forming apparatus has such drawbacks that since a special mechanism and a control unit are required to be additionally provided for changing over the transport speeds of the conveyor apparatuses, the apparatus becomes complicated in construction and large in size.

SUMMARY OF THE INVENTION

Accordingly, an essential object of the present invention is to provide an image forming apparatus with a view to eliminating the disadvantages inherent in conventional image forming apparatuses.

In order to accomplish this object of the present invention, an image forming apparatus according to the present invention includes a transport device for transporting a transfer paper sheet from a transfer section to a fixing section, the transport device comprising: a chevron-shaped suction deck which is formed with a suction opening; a transport belt which travels along an upper face of the suction deck; and a suction means for sucking the transfer paper sheet towards the transport belt through the suction opening of the suction deck.

By the above described arrangement of the image forming apparatus, the transfer paper sheet having passed through the transfer section is sucked towards the transport belt by the suction device so as to be conveyed to the fixing device through friction between the transfer paper sheet and the transport belt. At this time, since the suction deck supporting the transport belt is formed into a chevron-shaped configuration, the transfer paper sheet is curved arcuately by its own rigidity in the vicinity of the top portion of the suction deck so as to define a gap relative to the transport belt such that a slack surrounding the gap is formed on the transfer paper sheet.

Accordingly, when the leading edge of the transfer paper sheet proceeds into the fixing section and an impact force is transmitted to the trailing edge of the transfer paper sheet, the impact force is absorbed by the slack without being transmitted to the transfer section.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
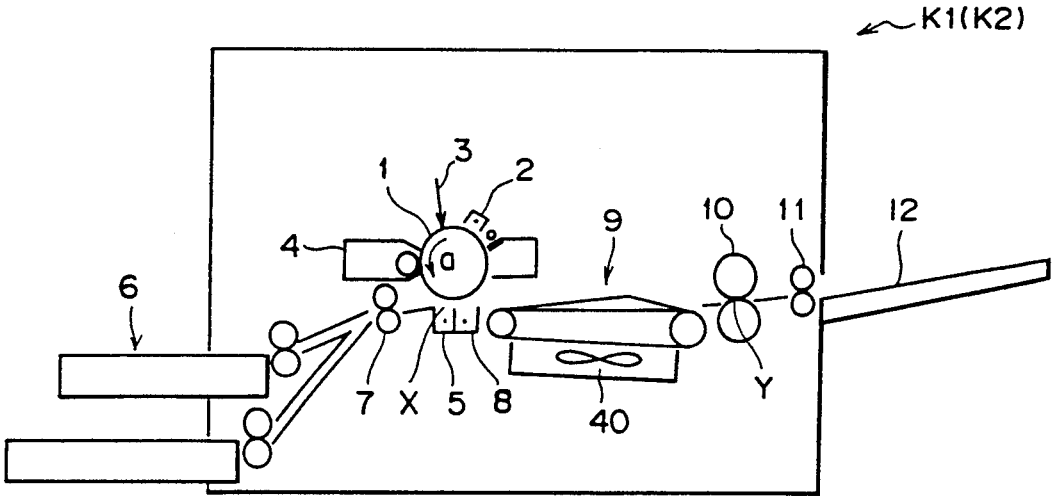
FIG. 1 is a schematic sectional view of an image forming apparatus according to a first embodiment of the present invention.

Referring now to the drawings, there is shown in FIG. 1, an image forming apparatus K1 according to a first embodiment of the present invention. In the apparatus K1, an outer peripheral surface of a photosensitive member 1 rotating in the direction of the arrow a is electrically charged by a corona charger 2 and imaging light 3 is exposed at the electrically charged region of the photosensitive member 1 so as to form an electrostatic latent image. The electrostatic latent image is developed into a visible toner image by a developing device 4. Then, at a section X confronting a transfer charger 5 (hereinbelow, referred to as a "transfer section"), the toner image on the photosensitive member 1 is transferred to a transfer paper sheet. The transfer paper sheet is supplied one sheet by one sheet from a paper feeding portion 6 and is delivered to the transfer section X synchronously with the toner image on the photosensitive member 1 by a pair of timing rollers 7.

Subsequently, the transfer paper sheet having passed through the transfer section X is separated from the photosensitive member 1 by a charge eraser 8 and is conveyed by a transport device 9 to a fixing device 10 where the toner image is fixed onto the transfer paper sheet. Thereafter, the transfer paper sheet is ejected onto a tray 12 by a pair of outlet rollers 11.

Figure 2:
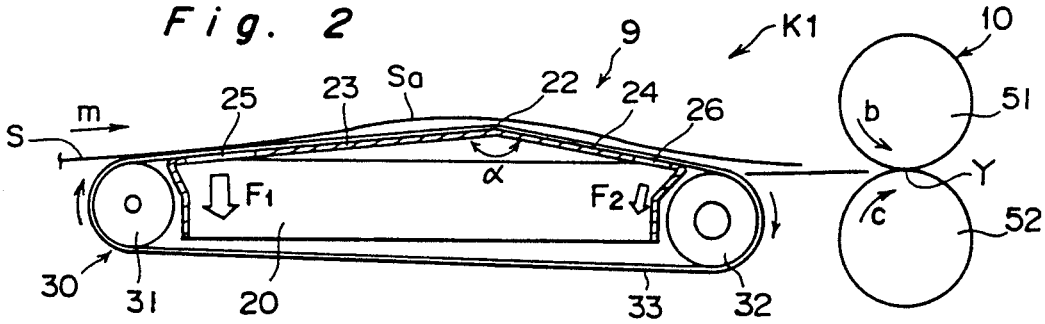
FIG. 2 is a sectional view of a transport device of the image forming apparatus of FIG. 1.

Hereinbelow, the transport device 9 which constitutes a main feature of the present invention is described with reference to FIGS. 2 to 4. The transport device 9 is substantially constituted by a suction deck 20, a conveyor device 30 and a suction device 40 (FIG. 1).

Figure 3:
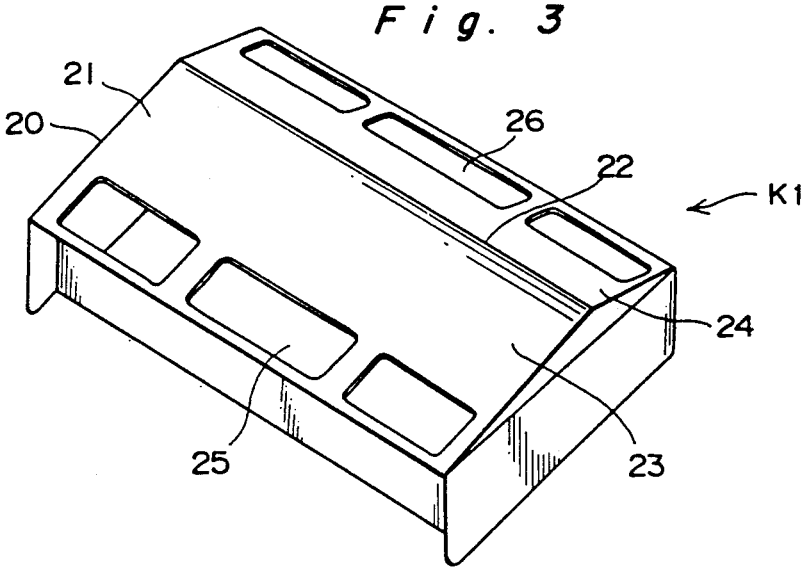
FIG. 3 is a perspective view of a suction deck of the transport device of FIG. 2.
Figure 4:
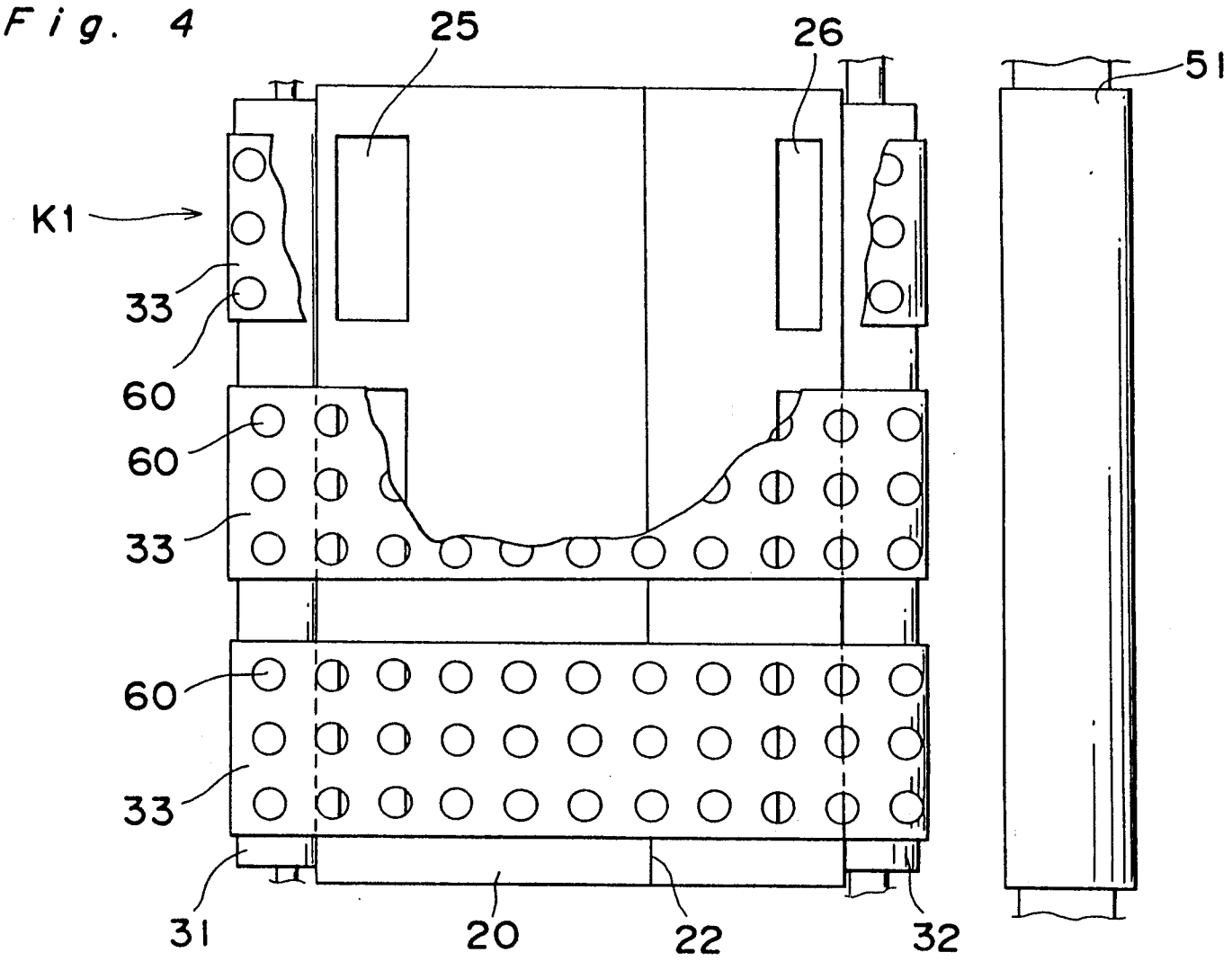
FIG. 4 is a top plan view of the transport device of FIG. 2.

As shown in FIG. 3, the suction deck 20 has an upper guide face 21 which is formed into a chevron-shaped configuration having a predetermined angle $\alpha$. Thus, the upper guide face 21 has an inclined face 23 at the side of the transfer section X and an inclined face 24 at the side of a fixing section Y. A top portion 22 of the upper guide face 21 deviates towards the fixing section Y from the center of the upper guide face 21. Therefore, the inclined face 23 is longer than the inclined face 24. Meanwhile, three rectangular suction openings 25 are formed at the foot of the inclined face 23, while three rectangular suction openings 26 are formed at the foot of the inclined face 24. An area of each of the suction openings 25 is made larger than that of each of the suction openings 26.

The conveyor device 30 is constituted by a pair of rollers 31 and 32 and three transport belts 33 each formed with a plurality of holes 60. The rollers 31 and 32 are, respectively, disposed adjacent to the transfer section X and the fixing section Y. The transport belts 33 are wound around the rollers 31 and 32 and the suction deck 20 and are supported along the upper guide face 21 of the suction deck 20 between the rollers 31 and 32.

The suction device 40 is disposed below the suction deck 20 so as to suck air above the transport belts 33 through the holes 60 of the transport belts 33 and the suction openings 25 and 26 of the suction deck 20.

In the above described arrangement of the image forming apparatus K1 the transfer paper sheet S having passed through the transfer section X is conveyed onto the suction deck 20 by a transport force of the timing rollers 7 and is sucked to the transport belts 33 by suction air drawn downwardly through the holes 60 of the transport belts 33 and the suction openings 25 by the suction device 40. The transfer paper sheet S sucked to the transport belts 33 is carried in the direction of the arrow m by travel of the transport belts 33 running around the suction deck 20 through rotation of the rollers 31 and 32 and is displaced obliquely upwardly along the inclined face 23 adjacent to the transfer section X. Subsequently, the transfer paper sheet S passes through the top portion 22 and then, travels obliquely downwardly along the inclined face 24 adjacent to the fixing section Y. In the course of downward travel of the transfer paper sheet S along the inclined face 24, the transfer paper sheet S is sucked to the transport belts 33 by suction air drawn downwardly through the holes 60 and the suction openings 26 by the suction device 40. Since the area of each of the suction openings 26 is smaller than that of each of the suction openings 25 as described above, a suction force F2 of the suction openings 26 adjacent to the fixing section Y is smaller than a suction force Fl of the suction openings 25 adjacent to the transfer section X.

Accordingly, the transfer paper sheet S is transported along the upper guide face 21 of the suction deck 20 and is displaced in an arcuately curved state in the vicinity of the top portion 22 of the suction deck 20. Namely, in the vicinity of the top portion 22, the transfer paper sheet S is displaced while being separated away from the transport belts 33 so as to form a slack Sa.

At the fixing device 10, an upper fixing roller 51 and a lower fixing roller 52 are, respectively, rotated in the directions of the arrows b and c. A leading edge of the transfer paper sheet S having passed through the transport device 9 is guided to the fixing section Y where the upper and lower fixing rollers 51 and 52 are brought into contact with each other. At this time, the leading edge of the transfer paper sheet collides with an outer peripheral surface of either one of the upper and lower fixing rollers 51 and 52 and thus, is subjected to an impact force. Therefore, the transfer paper sheet S being conveyed through the transport device 9 is retreated relative to the transport belts 33 travelling along the inclined face 24 adjacent to the fixing section Y such that amount of retreat of the transfer paper sheet S is absorbed by the slack Sa. Meanwhile, a portion of the impact force is transmitted also to the transfer paper sheet S being conveyed through the inclined face 23 adjacent to the transfer section X. However, since the suction force Fl at the suction openings 25 is made larger than the suction force F2 at the suction openings 26 as described above, the transfer paper sheet S is not retreated relative to the transport belts 33 travelling along the inclined face 23. Therefore, the toner image transferred to the transfer paper sheet S at the transfer section X is not disordered and thus, a high-quality image can be obtained.

Meanwhile, the bending angle $\alpha$ of the top portion 22 of the suction deck 20 varies according to rigidity of the transfer paper sheet S employed in the image forming apparatus K1. In the case of plain paper sheets used usually in a copying apparatus, a printer, a facsimile machine, etc., it is proper that the angle $\alpha$ assumes about 150 to 170°, most desirably 160 to 165° for forming the slack Sa.

Meanwhile, in the foregoing, the suction force Fl at the suction openings 25 adjacent to the transfer section X is made different from the suction force F2 at the suction openings 26 adjacent to the fixing section Y by making size of each of the suction openings 25 different from that of each of the suction openings 26. However, in order to make the suction forces Fl and F2 different from each other, it can also be so arranged that first and second suction devices are provided for the suction openings 25 and 26, respectively and air flow of the first suction device connected to the suction openings 25 is made larger than that of the second suction device connected to the suction openings 26.

As is clear from the foregoing description, in the image forming apparatus according to the first embodiment of the present invention, the impact force applied to the transfer paper sheet proceeding to the fixing section can be absorbed so as not to be transmitted to the transfer section by the simple arrangement without the need for additional provision of a mechanism and a control unit for changing over drive of the image forming apparatus during the image forming process.

Figure 5:
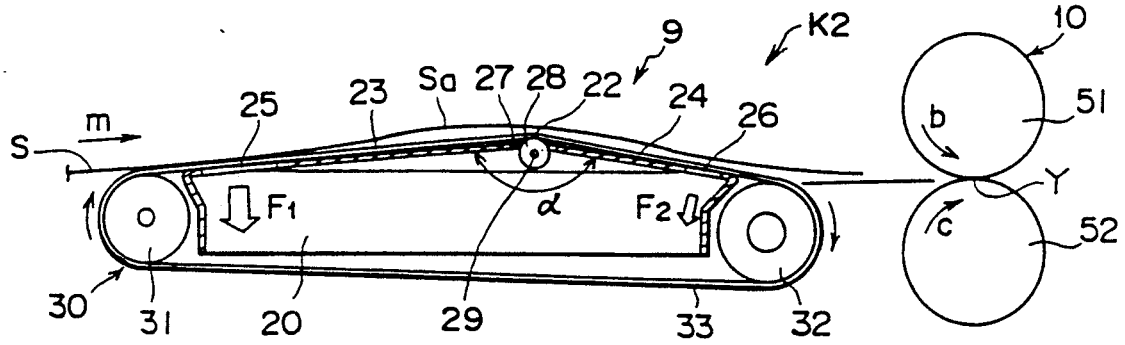
FIGS. 5 to 7 views similar to FIGS. 2 to 4, respectively, particularly showing a second embodiment of the present invention.
Figure 6:
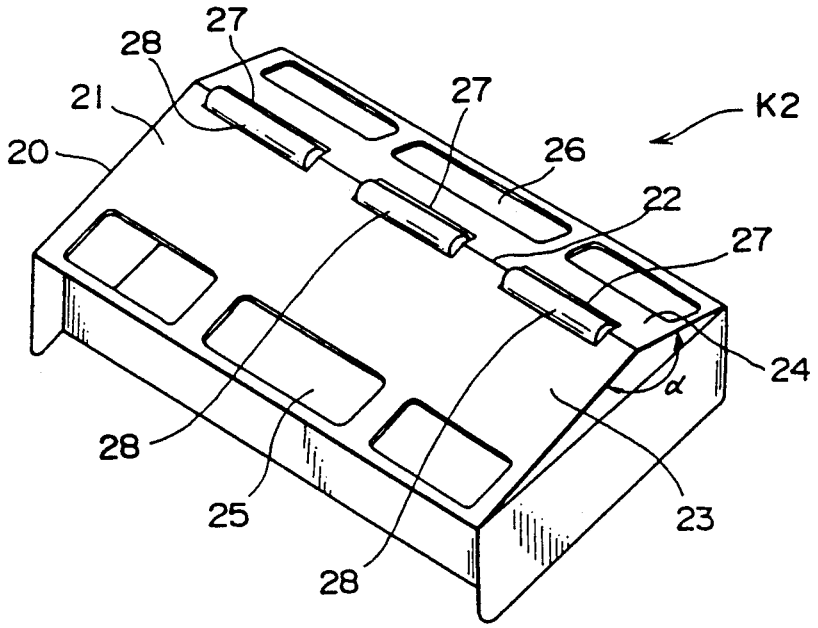
Figure 7:
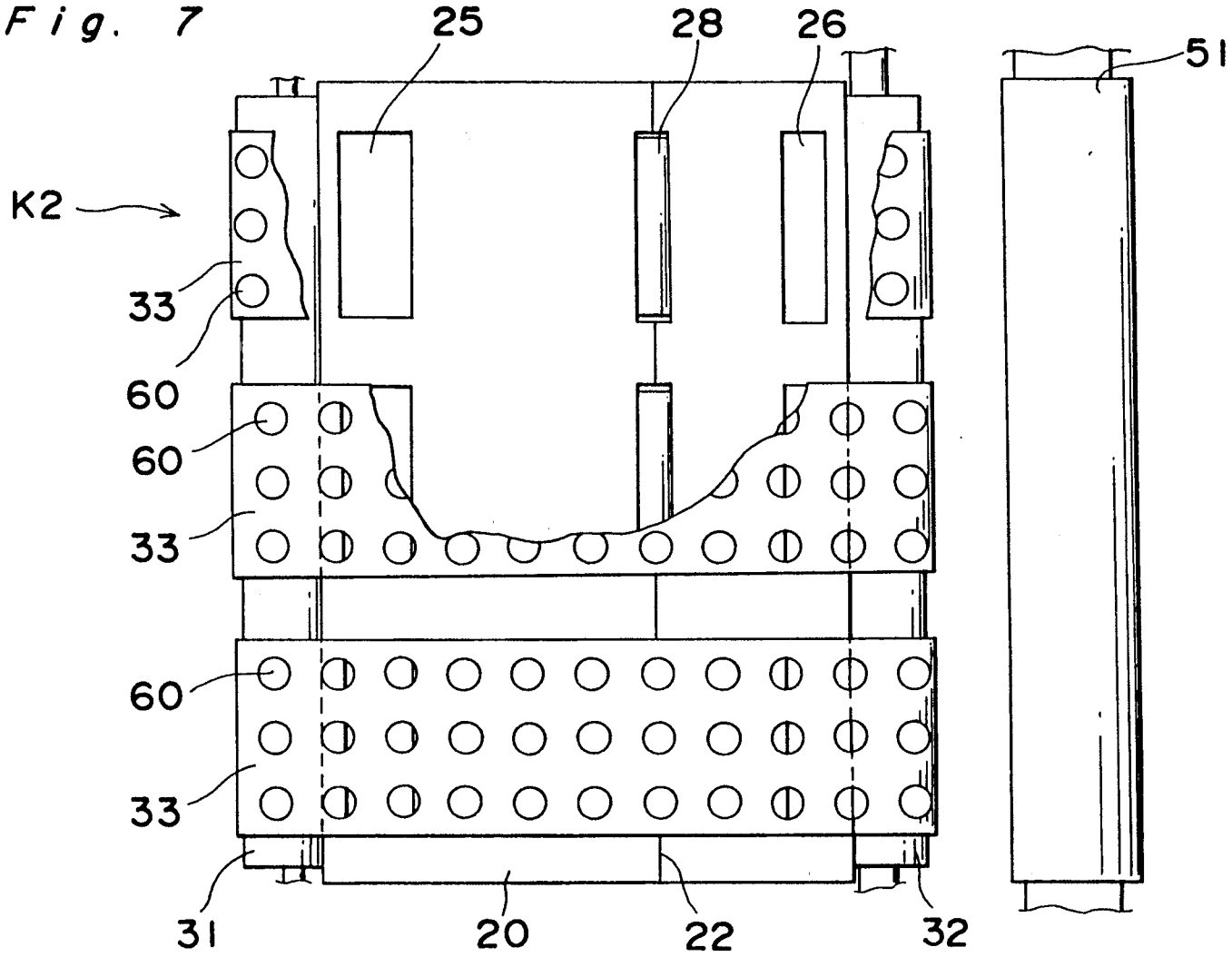

FIGS. 5 to 7 show the transport device 9 of an image forming apparatus K2 according to the second embodiment of the present invention. It is to be noted that FIG. 1 applies also to the image forming apparatus K1. As shown in FIG. 6, three rectangular openings 27 are formed at the top portion 22 of the suction deck 20 so as to extend at right angles with the transport direction of the transfer paper sheet S. A roller 28 is provided in each of the openings 27 such that an outer peripheral portion of the roller 28 projects upwardly from each of the openings 27. The rollers 28 are rotatably mounted on a shaft 29 traversing the suction deck 20. The transport belts 33 are wound around the rollers 31 and 32, the suction deck 20 and the rollers 28 disposed at the top portion 22 of the suction deck 20. Since other constructions of the image forming apparatus K2 are similar to those of the image forming apparatus K1, description thereof is abbreviated for the sake of brevity.

In the above described arrangement of the image forming apparatus K2, the transport belts 33 are carried in the direction of the arrow through rotation of the rollers 31 and 32 so as to pass over the rollers 28. The rollers 28 are arranged to be rotated through travel of the transport belts 33. Since the rollers 28 project upwardly from the top portion 22 of the suction deck 20, a frictional resistance force applied from the suction deck 20 to the transport belts 33 is small. Therefore, a load applied to a drive system of the rollers 31 and 32 is small and thus, it becomes possible to secure stable travel of the transport belts 33.

Meanwhile, if the transport belts 33 are displaced in contact with the suction deck 20, such a problem may arise that since toner penetrating between the transport belts 33 and the suction deck 20 is fused by frictional heat between the transport belts 33 and the suction deck 20, the fused toner functions as adhesive so as to immovably bond the transport belts 33 to the suction deck 20. However, in this embodiment, since the transport belts 33 are, respectively, guided by the rollers 28 at the top portion 22 of the suction deck 20 so as to be held out of contact with the suction deck 20, the above described problem is obviated.

The transfer paper sheet S sucked to the transport belts 33 by suction air drawn downwardly through the holes 60 and the suction openings 25 by the suction device 40 is conveyed in the direction of the arrow m by travel of the transport belts 33 and is displaced obliquely upwardly along the inclined face 23 so as to pass over the rollers 28 at the top portion 22. Subsequently, the transfer paper sheet S is carried obliquely downwardly along the inclined face 24.

As described above, the transfer paper sheet S is transported along the upper guide surface 21 of the suction deck 20 and is displaced in a gently curved state in the vicinity of the top portion 22 of the suction deck 20. Namely, in the vicinity of the top portion 22, the transfer paper sheet S is displaced while being spaced away from the transport belts 33 so as to form the slack Sa.

TABLE 1

| Basis wt. of transfer paper sheet (g/m$^2$) | Angle α (°) | | | | | |
|---|---|---|---|---|---|---|
| | 175 | 170 | 168 | 165 | 160 | 157 |
| 51.4 | C | C | C | B | B | B |
| 60 | C | C | C | B | A | A |
| 64 | C | C | B | A | A | A |
| 70 | C | B | B | A | A | A |
| 80 | B | B | A | A | A | A |
| 85 | B | A | A | A | A | A |
| 91.4 | A | A | A | A | A | A |
| 104.7 | A | A | A | A | A | B |
| 127 | A | A | A | A | A | C |
| 157 | A | A | A | A | B | C |
| 210 | A | B | B | B | C | C |

In the image forming apparatus K2, tests were conducted in which occurrence of positional deviation of a transferred image of the transfer paper sheet S from an image of an original document is observed by changing the angle α of the top portion 22 of the suction deck 20 and kinds of the transfer paper sheet S. Table 1 above shows results of the tests. In Table 1, character A represents high image quality having no positional deviation of the transferred image of the transfer paper sheet S from the image of the original document and character B represents intermediate image quality having slight positional deviation of the transferred image of the transfer paper sheet S from the image of the original document, which is usable for character images but is not usable for graphic images. Meanwhile, character C represents poor image quality having large positional deviation of the transferred image of the transfer paper sheet S from the image of the original document, which is usable for neither character images nor graphic images at all.

In the case where the transfer paper sheet S is thin so as to have small basis weight, Table 1 reveals that positional deviation of the transferred image of the transfer paper sheet S from the image of the original document is increased and is reduced as the angle α becomes larger and smaller, respectively. Reasons for these phenomena are as follows. Namely, the thin transfer paper sheet S has low rigidity and adhesion of the transfer paper sheet S relative to the photosensitive member 1 at the transfer section X is small. Therefore if the angle α is large, a sufficiently large slack is not formed on the transfer paper sheet S. As a result, an impact force at the time of travel of the transfer paper sheet S into the fixing section Y is directly transmitted to a portion of the transfer paper sheet S, which is disposed at the transfer section X, so that the portion of the transfer paper sheet S readily deviates in position, thereby resulting in positional deviation of the transferred image of the transfer paper sheet S from the image of the original document. However, if the angle α is reduced, a sufficiently large slack is formed on the transfer paper sheet S. Hence, an impact force produced at the time of travel of the transfer paper sheet S into the fixing section Y is absorbed by the slack and thus, is not transmitted to a portion of the transfer paper sheet S, which is disposed at the transfer section X, thereby resulting in elimination of positional deviation of the transferred image of the transfer paper sheet S from the image of the original document.

On the other hand, in the case where the transfer paper sheet S is thick so as to have large basis weight, Table 1 reveals that positional deviation of the transferred image of the transfer paper sheet S from the image of the original document is increased and reduced as the angle α becomes smaller and larger, respectively. Reasons for these phenomena are as follows. Namely, since the thick transfer paper sheet S has high rigidity, an impact force produced at the time of collision of the transfer paper sheet S with one of the upper and lower fixing rollers 51 and 52 is readily transmitted to the trailing edge of the transfer paper sheet S but adhesion of the transfer paper sheet S relative to the transfer section X is large. Hence, if the angle α is large, the transfer paper sheet S proceeds into the fixing section Y substantially straight, so that the impact force applied to the transfer paper sheet S is small. Therefore, even if the impact force is transmitted to a portion of the transfer paper sheet, which is disposed at the transfer section X, the transfer paper sheet S is immovably held at the transfer section X by the above described adhesion. On the contrary, if the angle α is small, the transfer paper sheet S having passed through the rollers 28 of the suction deck 20 collides with a side portion of the upper fixing roller 51 without being held in close contact with the transport belts 33 running on the inclined face 24. An impact force applied to the transfer paper sheet S at this time is large. Therefore, the potion of the transfer paper sheet S, which is disposed at the transfer section X, is not held at the transfer section X even by the above described adhesion, thereby resulting in production of positional deviation of the transferred image of the transfer paper sheet S from the image of the original document.

Since transfer paper sheets for use in image forming apparatuses usually have basis weight of 64 to 91.4 g/m$^2$, it is preferable from the foregoing that the angle α ranges from 160 to 165° in ordinary copying apparatuses, printers, etc.

As will be seen from the foregoing description, in the image forming apparatus according to the second embodiment of the present invention, since the rollers are rotatably provided at the top portion of the chevron-shaped suction deck, frictional force between the transport belts passing over the rollers and the suction deck is reduced, so that load applied to the drive system of the transport belts is decreased and thus, it becomes possible to secure stable drive of the transport belts.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An image forming apparatus comprising:

an image forming means for forming a toner image on a photosensitive member;

a transfer means for transferring the toner image on said photosensitive member to a recording paper sheet;

a fixing means for fixing the toner image on the recording paper sheet, onto the recording paper sheet, which is so provided as to be spaced a predetermined distance from said transfer means;

a guide member which has a first inclined face for obliquely upwardly guiding the recording paper sheet having the toner image transferred thereto by said transfer means and a second inclined face for obliquely downwardly guiding to said fixing means, the recording paper sheet guided above the first inclined face;

the first inclined face being formed with a first suction opening, while the second inclined face is formed with a second suction opening;

a transport belt means for transporting the recording paper sheet to said fixing means along the first and second inclined faces, which is wound along the first and second inclined faces and is formed with a plurality of holes; and a suction means which sucks air above the first inclined face through the holes of said transport belt means and the first suction opening and sucks air above the second inclined face through the holes of said transport belt means and the second suction opening so as to bring the recording paper sheet into close contact with said belt above said first and second inclined faces, respectively.

2. An image forming apparatus as claimed in claim 1, wherein said fixing means includes a pair of rollers so as to fix the toner image onto the recording paper sheet by passing the recording paper sheet between said rollers.

3. An image forming apparatus as claimed in claim 1, wherein a vertex of a chevron-shaped guide member connecting the first and second inclined faces deviates towards said fixing means from a center of said guide member.

4. An image forming apparatus as claimed in claim 1, wherein a suction force of said suction means from the first suction opening is larger than that from the second suction opening.

5. An image forming apparatus as claimed in claim 1, wherein an angle formed by the first and second inclined faces ranges from 160 to 165°.

6. An image forming apparatus comprising:

an image forming means for forming a toner image on a photosensitive member;

a transfer means for transferring the toner image on said photosensitive member to a recording paper sheet;

a fixing means for fixing the toner image on the recording paper sheet, onto the recording paper sheet, which is so provided as to be spaced a predetermined distance from said transfer means;

a guide member which has a first inclined face for obliquely upwardly guiding the recording paper sheet having the toner image transferred thereto by said transfer means and a second inclined face for obliquely downwardly guiding to said fixing means, the recording paper sheet guided therefore "above said" first inclined face;

the first inclined face being formed with a first suction opening, while the second inclined face is formed with a second suction opening;

a first roller means which is provided at a vertex of said guide member connecting the first and second inclined faces;

a second roller means which is so provided as to confront one end portion of the first inclined face adjacent to said transfer means;

a third roller means which is so provided as to confront one end portion of the second inclined face adjacent to said fixing means;

a transport belt means for transporting the recording paper sheet to said fixing means along the first and second inclined faces, which is wound around said first, second and third roller means along the first and second inclined faces and is formed with a plurality of holes; and a suction means which sucks air above the first inclined face through the holes of said transport belt means and the first suction opening and sucks air above the second inclined face through the holes of said transport belt means and the second suction opening so as to bring the recording paper sheet into close contact with the first and second inclined faces, respectively.

7. An image forming apparatus as claimed in claim 6, wherein said fixing means includes a pair of rollers so as to fix the toner image onto the recording paper sheet by passing the recording paper sheet between said rollers.

8. An image forming apparatus as claimed in claim 6, wherein a vertex of said chevron-shaped guide member connecting the first and second inclined faces deviates towards said fixing means from a center of said guide member.

9. An image forming apparatus as claimed in claim 6, wherein a suction force of said suction means from the first suction opening is larger than that from the second suction opening.

10. An image forming apparatus as claimed in claim 6, wherein an angle formed by the first and second inclined faces ranges 160 to 165°.

11. An image forming apparatus in which a transfer paper sheet having a toner image transferred thereto at a transfer section is transported to a fixing section where the toner image on the transfer paper sheet is fixed onto the transfer paper sheet, said image forming apparatus including a transport device for transporting the transfer paper sheet from said transfer section to said fixing section, said transport device comprising:

a chevron-shaped suction deck which is formed with a suction opening;

a transport belt which travels along an upper face of said suction deck; and a suction means for sucking the transfer paper sheet towards said transport belt through the suction opening of said suction deck.

12. An image forming apparatus in which a transfer paper sheet having a toner image transferred thereto at a transfer section is transported to a fixing section where the toner image o the transfer paper sheet is fixed onto the transfer paper sheet, said image forming apparatus including a transport device for transporting the transfer paper sheet from said transfer section to said fixing section, said transport device comprising:

a suction deck which extends in a chevron-shaped configuration from the transfer section to the fixing section so as to have an upward inclined face and a downward inclined face;

the upward and downward inclined faces being, respectively, formed with first and second suction openings;

a roller which is rotatably provided in the vicinity of a top portion of said suction deck;

a transport belt which travels, in contact with an upper face of said roller, along an upper face of said suction deck from the transfer section to the fixing section; and a suction device for sucking air above said suction deck through the first and second suction openings.

* * * * *

UNITED STATES PATENT AND TRADEMARK OFFICE

CERTIFICATE OF CORRECTION

PATENT NO. : 5,063,415

DATED : November 5, 1991

INVENTOR(S) : Takayuki Ariyama

It is certified that error appears in the above-identified patent and that said Letters Patent is hereby corrected as shown below:

In col. 2, line 22, before "views", insert --are--.

In col. 4, line 65, after "arrow", insert --m--.

In col. 6, line 12, after "Therefore", insert --,-- (comma).

In col. 7, line 53 (claim 1, line 32), change "said belt above" to --said transfer belt means above--.

In col. 8, lines 19 and 20 (claim 6, lines 16 and 17), change "therefore "above said"" to --above said--.

In col. 8, line 45 (claim 6, line 42), change "the" to --said transport belt means above said--.

In col. 9, line 16 (claim 12, line 4), change "o" to --on--.

On the cover page, change the title of the patent to --SUCTION TYPE CONVEYOR DEVICE FOR GUIDING THE RECORDING SHEET TO A FIXING DEVICE IN AN ELECTROSTATIC COPY APPARATUS--.

Signed and Sealed this

Sixth Day of April, 1993

*Attest:*

STEPHEN G. KUNIN

*Attesting Officer*

*Acting Commissioner of Patents and Trademarks*